US005570815A

United States Patent [19]

Ramsay

[11] Patent Number: 5,570,815

[45] Date of Patent: Nov. 5, 1996

[54] CHEMICAL DELIVERY SYSTEM

[75] Inventor: Bruce P. Ramsay, Milton, Vt.

[73] Assignee: International Business Machine Corp., Armonk, N.Y.

[21] Appl. No.: 468,118

[22] Filed: Jun. 6, 1995

[51] Int. Cl.[6] ..... B65D 35/28

[52] U.S. Cl. ..... 222/95; 222/105; 222/389

[58] Field of Search ..... 222/94–96, 105, 222/183, 189.1, 189.11, 381.5, 389, 255, 464.1, 464.7, 66, 377, 380, 387

[56] References Cited

U.S. PATENT DOCUMENTS

| | | | |
|---|---|---|---|
| 4,147,278 | 4/1979 | Uhlig | 222/95 |
| 4,993,594 | 2/1991 | Becker et al. | 222/94 |
| 5,195,655 | 3/1993 | Biskhman | 222/95 |

*Primary Examiner*—Andres Kashnikow
*Assistant Examiner*—Philippe Derakshani
*Attorney, Agent, or Firm*—Thornton & Thornton

[57] ABSTRACT

A chemical delivery system comprising a collapsible, container, such as a storage bag, positioned within a pressure vessel for providing delivery of a chemical fluid includes an inlet port on the uppermost portion of the storage bag and a withdrawal tube extending from the lowermost portion of the storage bag to its top. The withdrawal tube, which is made of the same material as the storage bag, is routed alongside, or within the storage bag, from the bottom to a point above the top. In one embodiment, the storage bag is carried within an rigid pressure vessel and the withdrawal tube is carried through a wall of the vessel without the use of inline fittings. In an alternate embodiment, the storage bag is secured within a less flexible bag, which provides a pressurizing receptacle. A filter and pump, both made of the same material as the storage bag are also welded in the withdrawal tube, and the pump comprises a pump storage bag within a pressure receptacle, preferably an outer less flexible bag, to facilitate pressurizing the pump storage bag and thereby pump its chemicals from the dispense tube.

19 Claims, 5 Drawing Sheets

CHEMICAL DELIVERY SYSTEM

FIELD OF THE INVENTION

The present invention generally relates to chemical delivery systems and more particularly to a batch delivery system employing a collapsible container.

BACKGROUND OF THE INVENTION

Precisely controlled, contaminant free delivery of chemical products is vital in many manufacturing processes, and particularly in the manufacture of semiconductor products. For example, the high density, high performance requirements of current semiconductor products require ultra pure delivery of photoresist, free of external gasses, moisture and other contaminants. Consequently, problems experienced in the production of semiconductor products have demonstrated a need for improved chemical delivery systems to accommodate high yield production.

Unfortunately, prior art fluid delivery systems generally incorporate a large number of components which contribute to contamination of the delivered product. For example, present systems incorporate components, such as probes, filters, reservoirs, valves, transducers and fittings in line with the chemical fluids, each of which can serve as sources for gas and moisture contamination and, depending upon the nature of the dispensed materials and the cleaning procedures employed, may retain chemical deposits so as to subsequently become a source of particulate contamination which, in turn, results in a loss of product.

Additionally, structural alterations employed to minimize gas and moisture infusion, or to vent induced gasses, often result in system configurations which preclude full use of all the chemicals of a given batch. For example, venting of pressurized containers and elimination of reservoirs in many of the present systems inhibit the effective use of sensors for determining when the chemical batch is near substantial depletion. On the other hand, alternate methods for signaling near depletion, and thus the need for changeover to another batch, are relatively conservative, and consequently, waste material.

SUMMARY OF THE INVENTION

An object of the present invention is to provide an improved chemical delivery system.

Another object of the present invention is to provide a substantially contaminant free, chemical delivery system.

Still another object of the present invention is to provide a fluid delivery system which substantially eliminates contamination of the delivered product.

A further object of the present invention is to provide an improved product delivery system utilizing a collapsible container arrangement.

A still further object of the present invention is to provide an improved product delivery system utilizing a collapsible container for both a batch storage and a pump arrangement of a chemical delivery system.

These desirable results and other objects are realized and provided by a fluid delivery system comprising a flexible batch storage container, such as a bag, mounted within a pressure receptacle, the storage container being configured for collapsing in response to an external pressure to deliver its fluid, the storage container having a hollow interior with a first portion located at a high point of the interior and a second portion located at a low point thereof when the storage container is in an operating attitude, an inlet port is coupled to the first portion for filling the storage container, and a withdrawal or dispensing tube extends from the second portion to the top of the storage container for dispensing fluid therefrom in response to a collapsing pressure exerted thereon.

Preferably, the withdrawal tube extends alongside, or within the storage container, and to the top thereof to minimize the inclusion of gasses in the chemicals retained therein. In one embodiment, a withdrawal port is coupled to the second portion and the withdrawal tube is hermetically connected to the withdrawal port and extended therefrom alongside the container to its top. In another embodiment, the withdrawal port is fitted to the top of the first portion and the withdrawal tube is extended within the container from the second portion through the withdrawal port and is hermetically connected thereto. A fitting is mounted on the inlet port for alternately opening and blocking the latter, and a tube is hermetically connected to it, so as to facilitate filling of the storage container. In the preferred embodiments, a pump is included in the delivery system in connection to the withdrawal tube, the pump comprising a collapsible pump container mounted within a pump pressure receptacle for dispensing chemicals therefrom in response to a collapsing pressure exerted on the pump container.

DESCRIPTION OF THE PREFERRED EMBODIMENT

Figure 1:
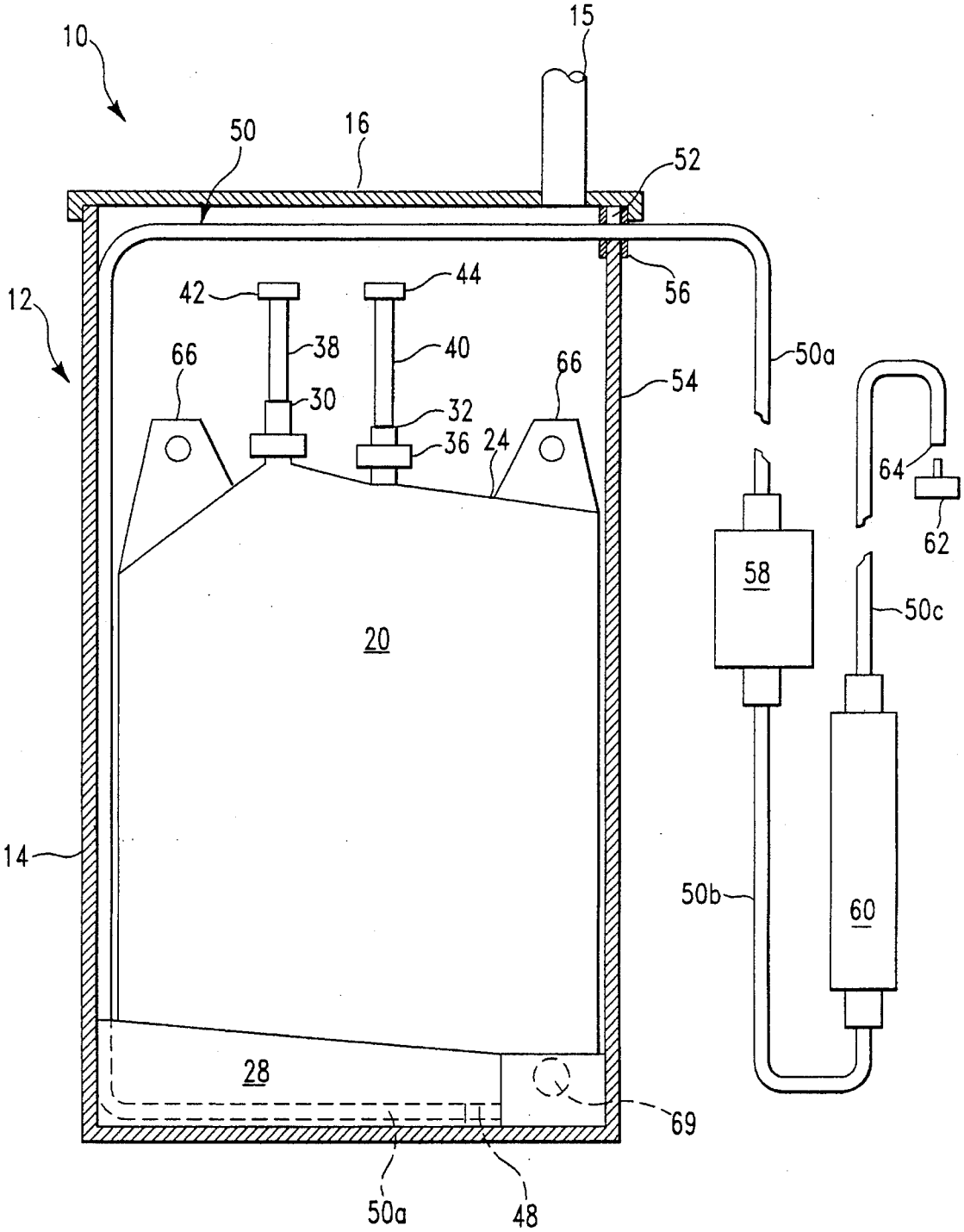
FIG. 1 is a diagrammatic view in elevation of the dispensing apparatus of the invention with an exterior receptacle sectioned to reveal a collapsible chemical storage container retained therein.
Figure 2:
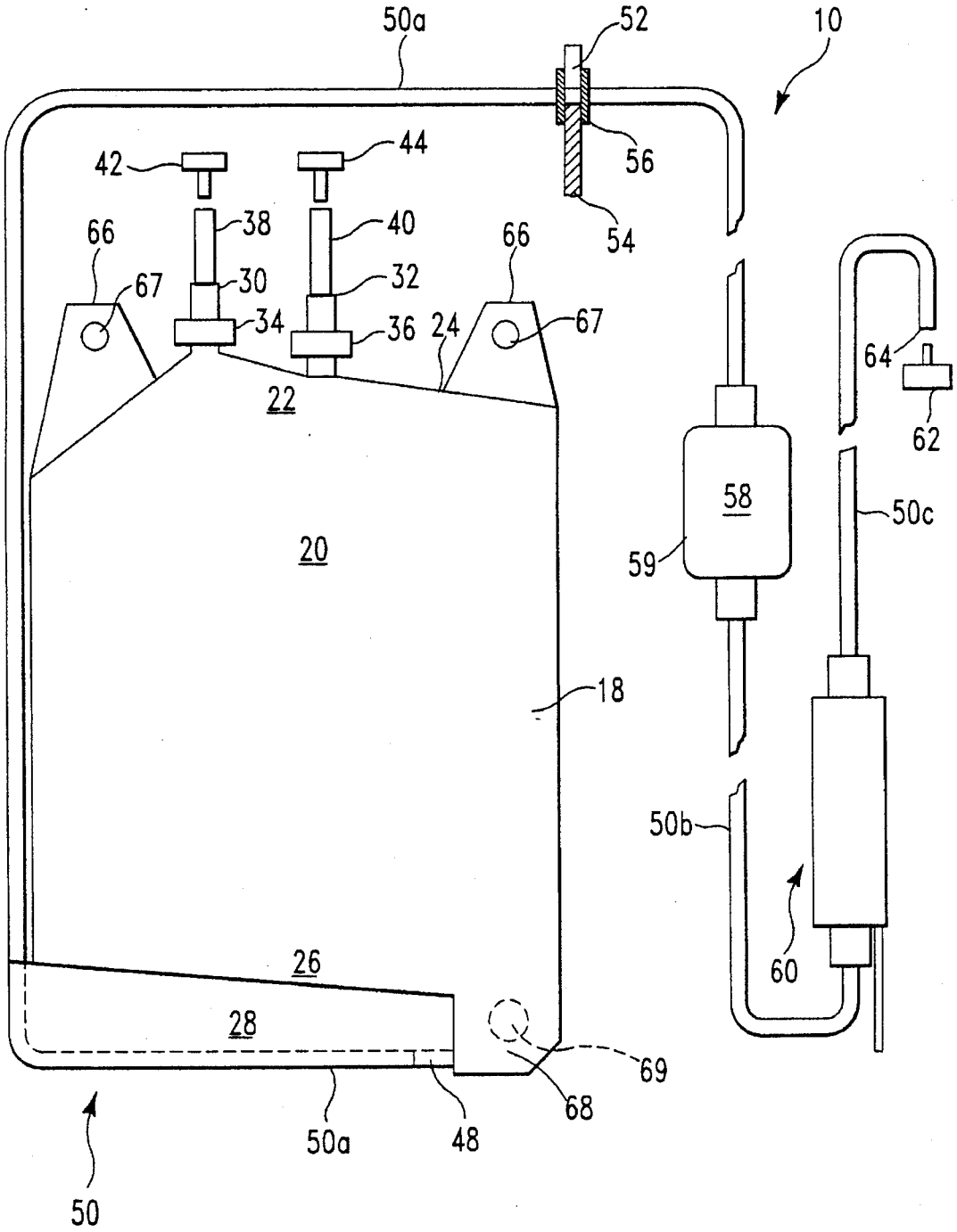
FIG. 2 is an enlarged view in elevation, with portions in cross section, of the storage container shown in FIG. 1.

A dispensing apparatus 10 provided in accordance with the invention, as illustrated in FIG. 1 and 2, includes a pressure vessel 12 comprising an open ended, cylindrical housing 14 and a cover or lid 16. A collapsible container, configured for storing a batch of chemicals, such as a collapsible storage bag 20 is retained within the pressure vessel 12 and includes a central portion 18, a top portion, or top section 22, located at the top 24 of the storage bag and a lower portion, or bottom section 26. The latter rests on a support base 28 of rigid plastic material which is designed to conform to the bottom contour of the collapsible storage bag 20. As later explained, the bag 20 is constructed as a unitized bag of a given plastic sheet material welded together.

An inlet port 30 and a vent port 32 are integrally formed as part of the top section 22 to permit filling and venting of the storage bag 20. The ports 30 and 32 carry clamps 34 and 36, respectively, for closing these ports when desired. Additionally, a fill tube 38 and a vent tube 40, preferably of the same material as the storage bag 20, are hermetically connected to the inlet and vent ports, 30 and 32, respectively, as by welding or otherwise suitably joined, to facilitate the filling and venting of the bag, as will be subsequently explained. A pair of plugs 42 and 44 close off the ends of the tubes 38 and 40, when the bag 20 has been filled as illustrated in FIG. 1. Hence, the bag is illustrated in a filled condition in FIG. 1, in readiness for transport and delivery of the chemicals, not shown. The plugs 42, 44 are shown more clearly in FIG. 2, in which the bag 20 is displayed in readiness for filling with its chemical liquid.

The bottom section 26 of the bag 20 carries an outlet port 48 to which a withdrawal tube 50 (comprised of three tube sections designated as 50*a*, 50*b*, and 50*c*) is hermetically attached by welding, for example. As shown in FIG. 1, the first tube section 50*a* is carried through a wall 54 of the pressure vessel 12 without the use of fittings. That is, the first tube section 50*a* is connected to the outlet port 48, and routed alongside the bag 20, over its top 24, and from the container housing 14.

To avoid inline fittings, which could become a source of contamination, the tube section 50*a* is carried through a slot 52 in the housing wall 54 with the aid of a split, compression grommet 56, which is constructed and arranged to be compressed by the lid 16 when the latter is secured to the container housing 14. Hence, as the lid 16 is clamped to the housing 14, the grommet 56 is squeezed and tightened slightly around the tube section 50*a* and to the wall 54, to enable sealing of the vessel 12. Any suitable means, such as toggle clamps, not shown may be utilized to affix the lid 16 to the housing 14. For pressurizing the vessel 12, to discharge its chemicals, a pressure tube 15 is fed into the interior of the housing 14.

In the preferred embodiment, the first tube section 50*a* extends from the housing 14 to a filter 58, with the second tube section 50*b* connected from the filter to a pump 60, and the third tube section 50*c* extended from the pump to define a dispensing nozzle. A cap 62 is provided for sealing the distal end 64 of the tube section 50*c*, once the apparatus has been charged with chemical fluid as will subsequently be described. The inline filter 58 and the inline pump 60 are preferably made of the same material as the unitized bag 20. The tube section 50*c*, which extends a moderate length to enable deliver of the chemicals from the pump 60, is also preferably made of the same material as the bag 20.

For handling and transporting the bag 20, a pair of tabs 66 are integrally formed with its top section 22. These tabs 66 extend upwardly from the top 24, as illustrated, and include an opening 67 for facilitating the lifting and carrying of the bag 20.

Advantageously, a sump like portion 68 is formed in the lowest point of the bottom section 24, as shown in FIGS. 1 and 2. In this embodiment, the sump portion 68 is positioned at one edge of the storage bag, however, it can also be centered (not shown) in the bottom of the collapsible bag. A sensor 69, shown in dotted outline in FIG. 2, can be carried in the sump portion to indicate when the chemical is near depletion thereby signaling the operator to change to a new batch. The location of the sensor 69 at the lowermost point of the bag 20 provides an effective chemical level sensor system which minimizes chemical waste.

To minimize contaminants and potential sources thereof, the bag 20, the tubes 36, 38 and 50, as well as the filter 58 and major portions of the pump 60, are all made of the same, or compatible material such as fluorocarbon polimers, polyamides or polyimides, for example, PTFEs. Further, the tubes 36, 38 and 50, are welded or vulcanized to the unitized bag 20 and the withdrawal tube section 50*a* is carried from the pressure vessel 12 without the use of fittings. Preferably, the bag 20 is constructed of sheet material, formed in the three sections, 18, 22 and 26, with each assembled from opposed sheets joined together, e.g. by welding, to form the sections, which are then, in turn, similarly joined to each other. Hence, it is important that inline materials utilized for the apparatus 10 be both inert and also compatible with the chemicals to be dispensed, and with cleaning of the apparatus. Further, the material should be susceptible to welding to itself or to otherwise being joined together, e.g., as by suitable chemical bonding compatible with a contaminant free assembly.

Following its assembly and prior to chemically filling, or charging of it, the apparatus 10 is cleaned and pressure checked. At the start of the filling operation, the inlet port 30 and tube section 50*c* are open, whereas the vent port 32 is clamped shut. The vent tube 40, and the tube section 50*c* are extended to a chemical recovery station, not shown, and the inlet tube 38 is connected to a filtered source of chemicals, also not shown, such that the chemicals will be filtered as the storage bag 20 is filled.

As the chemicals are fed into the storage bag 20, the apparatus 10 is initially purged, until free of all gasses, by allowing their escape from the open end 64 of the tube 50*c*. After this purging, and as the filling continues, the plug 62 is welded within the end 64 of the tube 50*c* to cap it, and the vent port 34 is then opened. This vents the top section 22 of the storage bag 20 to complete its filling.

When the top section 22 becomes completely filled, both the vent port 34 and the inlet port 32 are closed in that order by the clamps 36, 34, respectively, and the fill and vent tubes 38, 40 are cut short and capped, as depected in FIG. 1, thereby assuring that the system is isolated from external contaminants and gasses, which could otherwise infuse into the chemicals.

The use of the aforementioned clamps 34, 36 during connecting and disconnecting of the fill and vent tubes 38 and 40, ensures that the chemicals within the apparatus 10 are never exposed directly to the atmosphere. This minimizes the infusion of moisture and contaminants.

The filled storage bag 20 is then lifted by its tabs 66 and lowered into the housing 14. Of course, the storage bag 20 may also be filled, in the manner just described, with the bag already placed within the housing 14. In any event, the lid 16 is then fastened to the housing 14 to complete the vessel 12, and make the overall apparatus 10 ready for transport to its site of use. In that regard, the latter can be placed within, and transported in, a larger sized size container, not shown, to give added, overall protection to the chemical delivery system and its contents.

Prior to describing the dispensing of chemicals from the apparatus 10, the filter 58 and pump 60 will be described. The filter 58 is comprised of an outer shell 59 which encloses a filter core, not shown, preferably a micron filter formed of the same material as other inline portions of the apparatus 10.

Figure 3:
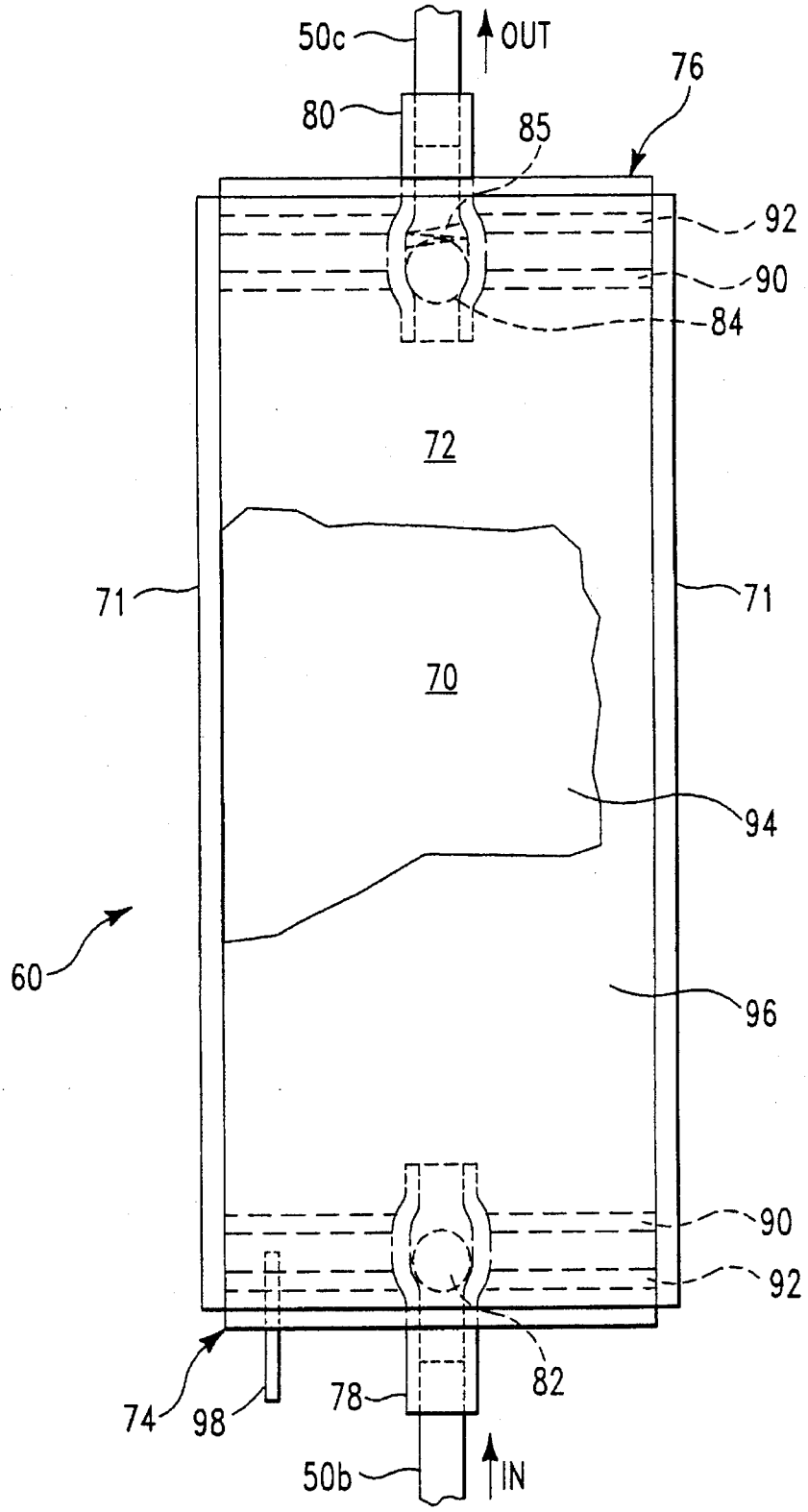
FIG. 3 is a view in elevation of the pump device illustrated in FIGS. 1 and 2 with portions cutaway to show its interior.

As illustrated in the FIG. 3, the pump 60 comprises a collapsible, pump storage bag 70 within a relatively rigid outer bag 72 which defines a pressure receptacle. The bags 70, 72 are formed from sheet material sealed together along longitudinal seams 71 and, as later explained, at an inlet end 74 and an outlet end 76. The inlet end 74 includes an inlet port 78, to which the tube section 50*b* is hermetically connected, and the outlet end 76 includes an outlet port 80 to which the tube section 50*c* is hermetically coupled.

An unbiased, check valve 82 (shown in dotted outline) is carried within the inlet port 78 and a spring biased, check valve 84 is carried within the outlet port 80. The check valves 82 and 84 are spherical, caged ball type valves, and the outlet valve 84 is biased closed by a spring 85 designed to provide a low spring release force, in the order of 6 psi, or slightly greater.

The inline pump materials, are made of the same, or similar materials as that of the storage bag 20 to minimize contaminants. It should be noted however, that the check valves 82 and 84 may be made of a metal, which is suseptable to easy cleaning. Futher, the outer bag 72 is not inline with, or exposed to the chemicals for which the system is designed, and also that this bag must be more rigid than the collapsible pump storage bag 70. Thus, the outer bag 72 could be of made of many different materials. However, since it must be joined to the pump storage bag 70 as will be subsequently explained, it is preferably made from the group of materials previously noted as desirable for the bag 20 and other inline elements, but of thicker material than the pump storage bag 70.

For construction of the pump 60, the inlet and outlet ports, 78 and 80, are separately formed of preferably the same material as the pump bag 70, and in enclosing relation with the check valves 82 and 84, respectively. The pump storage bag 70 is formed of opposed sheets, a portion of one being shown in FIG. 3 and designated as 94, welded to each other along the longitudinal seams 71, and further welded to the ports 78 and 80 and to each other along inwardly positioned, horizontal welds, or horizontal seams 90 at each of the ends 74, 76. Thus, the longitudinal seams 71 along with the horizontal seams 90 form the inner bag 70 joined to its ports 78, 80.

In turn, the outer bag 72 is also preferably formed of opposed sheets, one of which is shown at 96, welded to opposite sides of the pump storage bag 70 along the longitudinal seams 71 and outwardly positioned, horizontal seams 92 at each of the ends 74, 76. Thus, the longitudinal seams 71 along with the horizontal seams 92 form the outer bag 72. While not necessary to the construction, the pump storage bag 70 is preferably, also welded to itself and the ports 74, 78 in the outwardly positioned seams 92 so as to strengthen the pump assembly 60.

A pressure tube 98 extends through the horizontal seam 92 at the end 74, as shown, between the outer layer 96 and the inner layers 94 to a position between the inner and outer bags 70, 72. Hence, as later explained in more detail, the pump 60 is rendered operable by introducing pressurized gas, such as air, through the tube 98 to pressurize the space between the outer bag 72 and the inner bag 70, and thereby collapse the latter. As can be appreciated, the outer bag 72, which extends between the outer seams 92, when pressurized, will provide compression, or that is a collapsing force, along the full length of the inner bag 70 which extends between the innermost seams 90. Both bags 70 and 72 could be welded together in different arrangements, such as at the inner seams 90, however, the collapsing force on the inner bag would then be less efficient.

As will be more fully understood in regard to the overall operation of the apparatus 10, the pump 60 is repeatedly pressurized through its pressure tube 98 to cycle the pump for periodical delivery of its contained liquid. In this regard, the outer bag 72 is first pressurized to a value greater than the bias of the outlet valve 84, such that the pressure, thereby exerted on the liquid within the pump storage bag 70, will close the inlet check valve 82 and open the outlet valve 84 as it overcomes the bias of the latter. This forces the pump contained chemicals into the tube section **50*c* and from its distal end 46**.

In the next half cycle of the pump 60, as the pressure in the bag 72 is reduced, the force on the storage bag 70 accordingly diminishes, the outlet valve 84 closes under the bias of its spring 85, and the pump action stops. At this time, if there is pressure at the inlet port 78 from the storage bag 20, the inlet valve 82 will open to allow the pump storage bag 70 to again fill with chemicals.

The overall dispensing of chemicals from the apparatus 10 will now be explained with reference to FIGS. 1 and 2. To dispense the stored chemicals from the storage bag 20, the capped end 64 of the tube section **50*c* is snipped to open this tube, and the vessel 12 pressurized to a low constant pressure by introducing a gas, such as air, under pressure to the vessel 12 through the pressure tube 15. This exerts a compression or collapsing force on the storage bag 20 to urge its liquid toward the filter 58 and the pump 60. The pressure directed to the vessel 12 is made low enough so as to not force open the pump valve 84. This leaves actual dispensing from the apparatus 10 under the control of the pump 60**, as explained below.

Upon each cycle of pump pressure, when the pump storage bag 70 has been completely collapsed, a precise amount of the chemicals has been dispensed. Then, as the pump pressure is reduced, the outlet valve 84 closes under the bias of the spring 85 to allow the pump to again fill (through the inlet check valve 82) from the storage bag 20 in preparation for the start of a next cycle of the pump 60. In turn, at each pressurizing cycle of the pump 60, the chemical will be dispensed from the tube **50*c*. Hence, the pump cycle is repeated as desired to accordingly dispense the chemicals until the liquid in the storage bag 20 is depleted; the latter being signaled to the operator by the sensor 69**.

Figure 4:
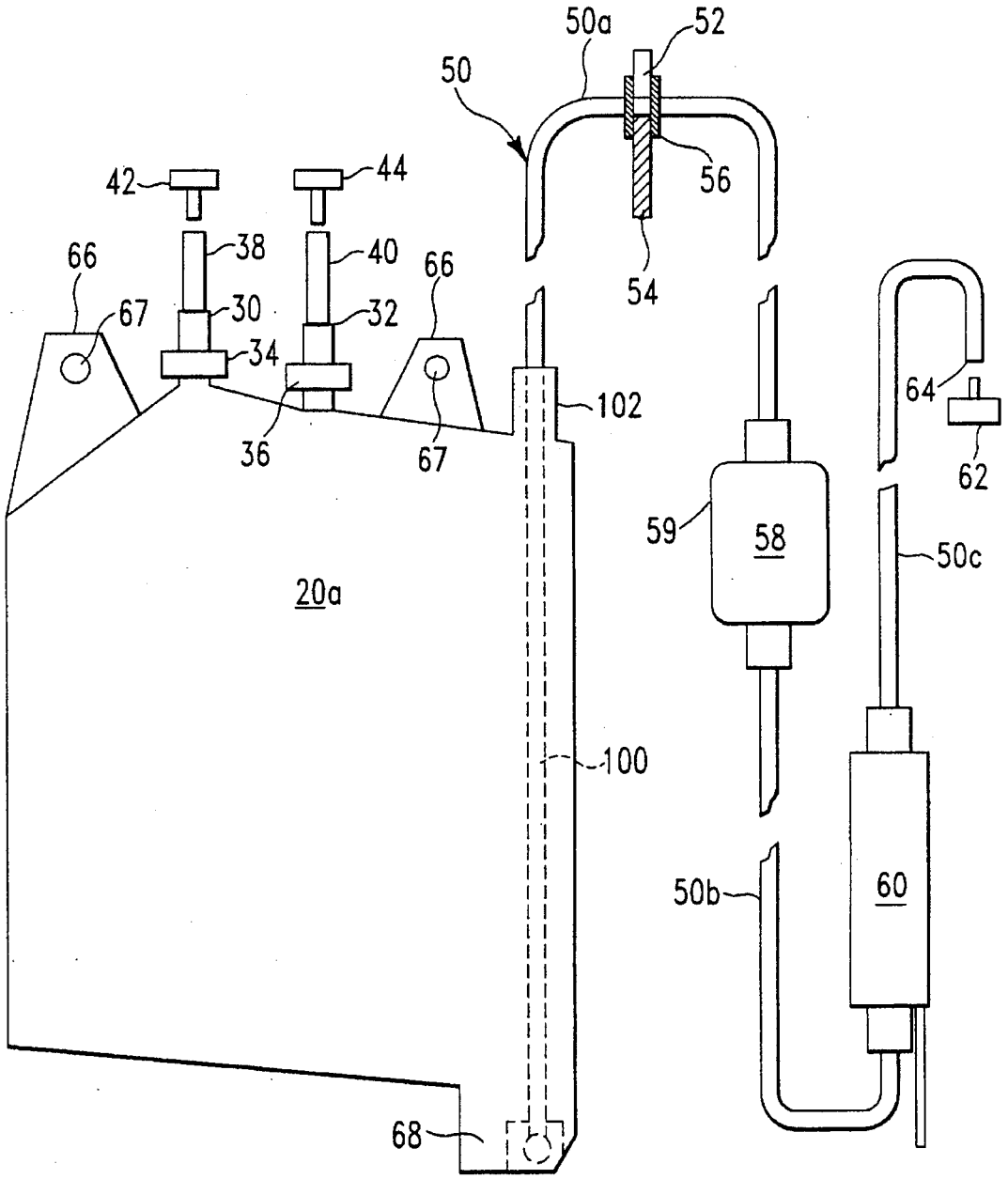
FIG. 4 is a view in section of an alternate embodiment of a flexible bag system provided in accordance with the invention.

In FIG. 4, an alternate embodiment of a collapsible bag system, constructed in accordance with the invention, is shown. In this figure, elements identical to those of FIGS. 1 and 2 are identified by the same numeral. Herein, a collapsible storage bag **20*a* is illustrated, which is almost identical to the storage bag; the exceptions being that a withdrawal tube 100 extends (from the sump 68) within the interior of the storage bag 20*a* and through an outlet port 102 (to which it is hermetically sealed) at the top of the bag. While this arrangement may more slightly complicate the sheet construction previously described for the collapsible storage bag 20, it has the advantage that it eliminates an external path of the withdrawal tube 100 alongside the storage bag 20*a***, and thus, provides added protection for that tube.

Figure 5:
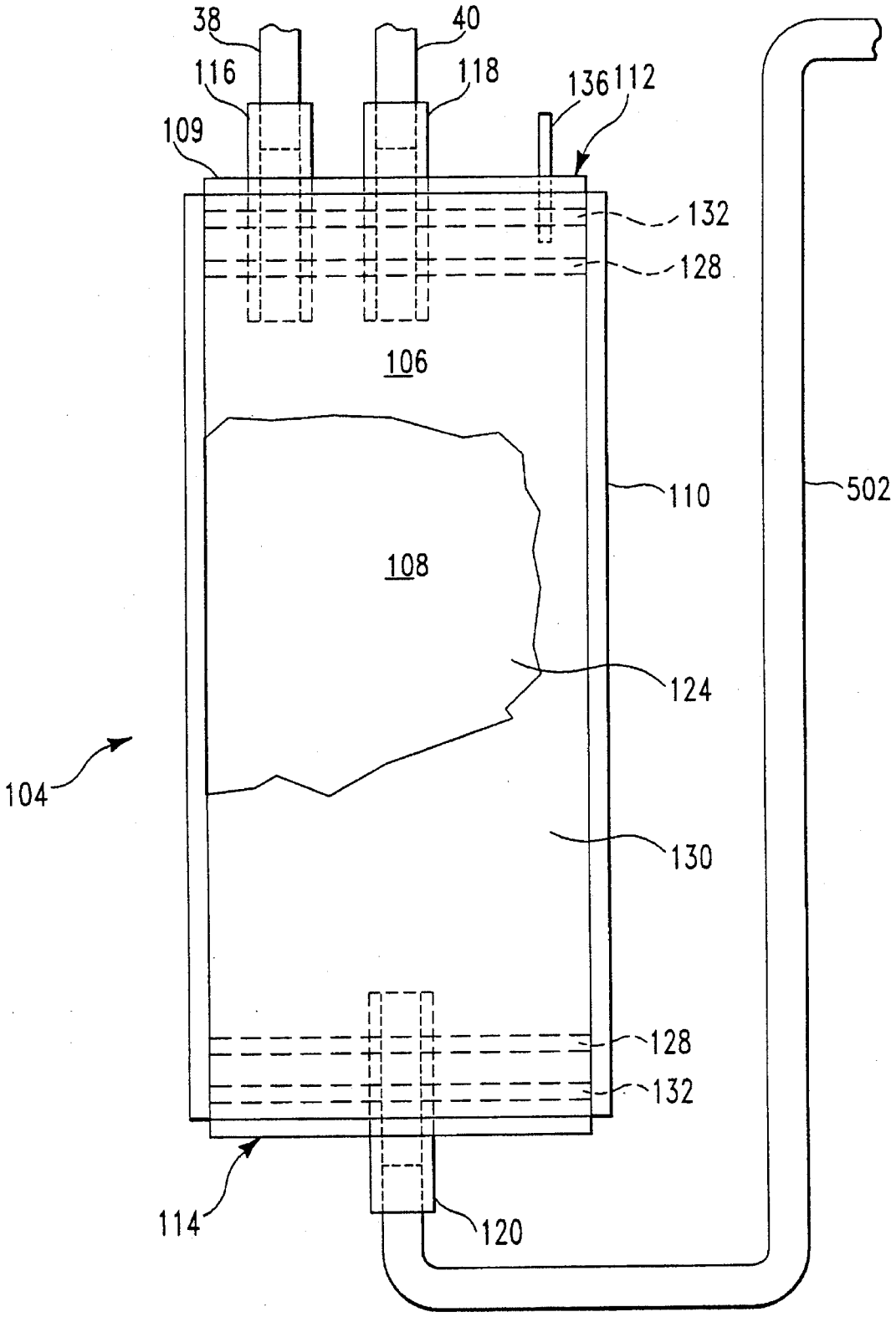
FIG. 5 is a view in elevation of still another embodiment of a collapsible storage container in accordance with the invention.

In FIG. 5, a double bag assembly 104 is illustrated for chemical batch storage and transport. Thus, in this assembly 104, the pressure vessel 12 is replaced with a pressurizable bag 106 which encloses a storage bag 108 (similar to the bag 20) as illustrated in FIG. 5. Like the double bag arrangement of the pump 60, the storage bag 108 is preferably of the same, or similar materials as that of the storage bag 20, and all inline materials of the apparatus. On the other hand, the outer bag 106, which is not inline and thus, can be of different material, may be constructed of plastic material which is more firm than that of the storage bag to provide a pressure receptacle for the latter. Hence, the outer bag can be of different material, however, since it must be joined to the storage bag 108, it is preferably made of at least similar, but thicker, material than the latter.

Advantageously, the outer bag 106 takes the place of the heavy pressure vessel 12 so as to provide a compact, light weight unit suitable for both manufacturing and laboratory use. In the preferred embodiment, the bags 106 and 108 are formed from sheet material sealed together along longitudinal seams 110, and at an inlet end 112 and an outlet end 114. The inlet end 112 includes an inlet port 116, to which the fill tube 38 is hermetically connected, and a vent port 118 to which the vent tube 40 is hermetically coupled. Like the bag 20, the ports 116 and 118 carry clamps 34, 36, respectively, and as in the embodiment of FIG. 1 and 2, the outlet end 114 in turn, includes an outlet port 120 to which the tube section 50*a* is hermetically coupled. The tube section 50*a*, in turn, extends to the top 109 of the assembly 104, to the filter 58, and with the tube section 50*b* extending therefrom to the pump 60 in the manner illustrated in FIG. 2.

For construction of the double bag assembly 104, the inlet, vent and outlet ports, 116, 118 and 120, may be formed as extended portions of the inner bag 108 or separately formed, preferably of the same material as other inline materials. The assembly 104, like the pump assembly illustrated in FIG. 3, is constructed from opposed sheets of inert plastic material. For the storage bag 108, opposed sheets (a portion of one being shown in FIG. 3 and designated as 124), are welded to each other along the longitudinal seams 110, and also along inwardly positioned, horizontal weld areas, or horizontal seams 128 at each of the ends 112 and 114. Thus, the longitudinal seams 110 along with the horizontal seams 128 form the inner bag 108. In turn, the outer bag 106 is also preferably formed of opposed sheets, one of which is shown at 130, welded to the longitudinal seams 110 of the storage bag 108 and along outwardly positioned, horizontal seams 132 at each of the ends 112 and 114. Thus, the longitudinal seams 110 along with the seams 132 form the outer, presurizable bag 106.

While not necessary to the construction, the storage bag 108 may also be welded to itself in the outwardly positioned, horizontal weld areas 132 to strengthen the double bag assembly 104. To complete the assembly 104, a pressure tube 136 extends through one of the horizontal seams 132, between the outer layer 130 and the inner layer 124 to allow pressurization of the separation between the bags 106 and 108, and thus, the compression of the latter.

The filling, purging and venting of the assembly 104 is identical to that described with respect to the embodiment shown in FIGS. 1 and 2. Similarly, the withdrawal port 120 may alternately be formed in the inlet end 112 of the storage bag 108 and the tube section 50*a* extended from within the this bag to and through the port 120 in the same manner as described with regard to FIG. 4.

This completes the description of the preferred embodiments of the invention. Since changes may be made in the above structure and process without departing from the scope of the invention described herein, it is intended that all the matter contained in the above description or shown in the accompanying drawings shall be interpreted in an illustrative and not in a limiting sense. Thus other alternatives and modifications will now become apparent to those skilled in the art without departing from the spirit and scope of the invention as set forth in the following claims.

What is claimed is:

1. A chemical delivery system comprising:

a) a collapsible, chemical storage container having a hollow interior, said storage container including a first portion forming the top and a second portion forming the bottom of said chemical storage container;

b) an inlet port coupled to said first portion in at least adjoining relation to an uppermost point thereof;

c) a delivery tube hermetically connected to said container for dispensing fluid from said interior, said delivery tube extending from a point in at least adjoining relation to the lowermost point of said second portion to a point at least equal to the top of said container to facilitate purging of said container through said delivery tube during filling with chemicals; and d) a pressure vessel enclosing said storage container, said vessel being pressurizable for applying compression to said chemical storage container to urge its contained chemicals through said delivery tube.

2. The invention of claim 1 wherein said pressure vessel is a pressure bag sealed around said chemical storage bag.

3. The invention of claim 1 including a withdrawal port coupled to said first portion in adjoining relation to the top thereof, and said delivery tube extends within said container from a point adjoining the bottom thereof through said withdrawal port to which it is hermetically coupled.

4. The invention of claim 1 including a withdrawal port coupled to said second portion in at least adjoining relation to the bottom thereof, and said delivery tube is hermetically connected to said withdrawal port, and extended alongside said container and to the top thereof.

5. The invention of claim 1 including a vent port coupled to said first portion in at least adjoining relation to an uppermost point thereof.

6. The invention of claim 5 including a fitting coupled to each of said inlet port and vent ports, respectively, for selectively closing said ports.

7. The invention of claim 1 wherein said chemical storage container is a chemical storage bag constructed from opposed sheets of film material sealed to each other.

8. The invention of claim 7 wherein said pressure vessel is a pressure bag sealed around said chemical storage bag.

9. The invention of claim 7 wherein said chemical storage bag is constructed from the group consisting of fluorocarbon polimers, polyamides or polyimides.

10. The invention of claim 1, further including at least one component from the group of a pump, and a filter hermetically coupled to said delivery tube, and said chemical storage container and said components being constructed of fluorocarbon polimers.

11. The invention of claim 10 wherein said at least one component is a pump connected in said delivery tube, said pump comprising a collapsible pump storage container positioned within a pressure receptacle pressurizable to compress said pump storage container for dispensing its chemicals, and wherein said chemical storage container and said pump storage container each comprise bags constructed of fluorocarbon polimers.

12. The invention of claim 11 wherein said storage bags are each constructed from opposed sheets of film material sealed together.

13. The invention of claim 12 wherein said pressure vessel and said pressure receptacle are each a pressure bag sealed around each said storage bag, respectively.

14. The invention of claim 13 wherein said storage bags are constructed from the group consisting of fluorocarbon polimers, polyamides or polyimides.

15. A chemical delivery system comprising:

a) a collapsible, chemical storage container having a hollow interior, said storage container including a first portion forming the top and a second portion forming the bottom of said storage container;

b) an inlet port coupled to said first portion in at least adjoining relation to an uppermost point thereof;

c) a delivery tube hermetically connected to said container for dispensing fluid from said interior;

d) a pressure vessel enclosing said storage container, said receptacle being pressurizable for compressing said chemical storage container to urge its contained chemicals through said delivery tube;

e) a collapsible pump storage container connected in said delivery tube, said pump storage container being configured for receiving chemicals from said chemical storage container when said chemical storage container is compressed; and f) a pressure receptacle enclosing said pump storage container, said receptacle being pressurizable for compressing said pump storage container to urge the chemicals therein through said delivery tube.

16. The invention of claim 15 wherein said chemical storage container and said pump storage container comprise collapsible bags constructed of fluorocarbon polimers.

17. The invention of claim 16 wherein said pressure vessel and said pressure receptacle are each a pressure bag sealed around each said storage bag, respectively.

18. The invention of claim 16 wherein said chemical storage container and said pump storage container are storage bags, each constructed from opposed sheets of film material sealed together.

19. The invention of claim 18 wherein said storage bags are constructed from the group consisting of fluorocarbon polimers, polyamides or polyimides.

* * * * *